US009229380B2

(12) United States Patent
Nanjo

(10) Patent No.: US 9,229,380 B2
(45) Date of Patent: Jan. 5, 2016

(54) FIXING DEVICE AND IMAGE FORMING APPARATUS

(71) Applicant: KYOCERA DOCUMENT SOLUTIONS INC., Osaka (JP)

(72) Inventor: Yuzuru Nanjo, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 144 days.

(21) Appl. No.: 13/784,411

(22) Filed: Mar. 4, 2013

(65) Prior Publication Data

US 2013/0259508 A1 Oct. 3, 2013

(30) Foreign Application Priority Data

Mar. 29, 2012 (JP) ..... 2012-075452

(51) Int. Cl.
*G03G 15/20* (2006.01)

(52) U.S. Cl.
CPC ..... *G03G 15/2021* (2013.01); *G03G 15/2042* (2013.01); *G03G 15/2017* (2013.01); *G03G 15/2053* (2013.01)

(58) Field of Classification Search
CPC ..... G03G 15/2039; G03G 15/2017; G03G 15/2021
USPC ..... 399/69, 92, 329, 334
See application file for complete search history.

(56) References Cited

U.S. PATENT DOCUMENTS

2008/0056755 A1 3/2008 Koshida

FOREIGN PATENT DOCUMENTS

| | | | | |
|---|---|---|---|---|
| JP | 61-011774 | A | | 1/1986 |
| JP | 03-139682 | A | | 6/1991 |
| JP | H04-051179 | A | | 2/1992 |
| JP | 06-242701 | A | | 9/1994 |
| JP | 09114286 | A | * | 5/1997 |
| JP | H09-114286 | A | | 5/1997 |
| JP | 2002132078 | A | * | 5/2002 |
| JP | 2005208286 | A | * | 8/2005 |
| JP | 2006047393 | A | * | 2/2006 |
| JP | 2006-267426 | A | | 10/2006 |
| JP | 2008-058378 | A | | 3/2008 |
| JP | 2010-181468 | A | | 8/2010 |

OTHER PUBLICATIONS

Miyoshi (JP 09-114286 A), May 1997, JPO Computer Translation.*
Nagase (JP 2002-132078A), May 2002, JPO Computer Translation.*
An Office Action; "Notice of Reasons for Rejection," issued by the Japanese Patent Office on Jun. 17, 2014, which corresponds to Japanese Patent Application No. 2012-075452 and is related to U.S. Appl. No. 13/784,411.

* cited by examiner

*Primary Examiner* — Erika J Villaluna
(74) *Attorney, Agent, or Firm* — Studebaker & Brackett PC

(57) ABSTRACT

A fixing device includes a first rotating member, a second rotating member and a blowing unit. The first rotating member is heated by a heat source. The second rotating member is pressed against the first rotating member to form a fixing nip with the first rotating member along a conveying path of a recording medium. The blowing unit blows a cooling airflow toward the first rotating member. An airflow route from the blowing unit to the first rotating member is arranged so as to cross the conveying path.

17 Claims, 7 Drawing Sheets

FIXING DEVICE AND IMAGE FORMING APPARATUS

INCORPORATION BY REFERENCE

This application is based on and claims the benefit of priority from Japanese Patent application No. 2012-075452 filed on Mar. 29, 2012, the entire contents of which are incorporated herein by reference.

BACKGROUND

The present disclosure relates to a fixing device for fixing a toner image on a recording medium, such as a sheet or a film, and an image forming apparatus provided with the fixing device.

An electrographic image forming apparatus, such as a copying machine or a printer, is provided with a fixing device for fixing a toner image on a recording medium, such as a sheet or a film. For the fixing device, a heat fixing manner is generally applied to fuse a toner (a developer) by heating and to fix it onto the sheet. The fixing device with the heat fixing manner is provided with a first rotating member (e.g. a fixing roller) heated by a heat source and a second rotating member (e.g. a pressing roller) pressed against the first rotating member so that a fixing nip is formed between the first and second rotating members.

As a system for the aforementioned rotating members, a heat roller system having each roller as a rotating member is most often applied from a point of view of thermal efficiency and safety. On the other hand, in order to satisfy requests, such as reduction of a warm-up time and saving energy, a belt system having at least one rotating member as a belt has received attention in recent years. As the heat source for heating the aforementioned rotating member, a halogen lamp is generally utilized, but there are many products utilizing a ceramic heater or an induction heating (IH) coil to enable quick-heating and high-efficiency heating.

Incidentally, in the aforementioned fixing nip, the toner image is fixed onto the various recording mediums with different widths according to user's needs. When the toner image is fixed on a recording medium with a first size in the fixing nip, in one region on the first rotating member which the first size recording medium passes (hereinafter, called as "a first sheet passing region"), the first size recording medium and non-fixed toner are heated, thereby consuming heat. On the other hand, in another region outside the first sheet passing region which another recording medium with a second size having a broader width than the first size recording medium passes (hereinafter, called as "a first non-sheet passing region"), there is no consumed heat. Therefore, the temperature of the first non-sheet passing region on the first rotating member is higher than the temperature of the first sheet passing region, and then, a temperature distribution of the first rotating member becomes non-uniform.

Such non-uniformity of the temperature distribution is especially intensified when the toner image is continuously fixed on the first size recording medium (e.g. a standard sized sheet called B5). In a situation of such an non-uniformit of temperature distribution, when the toner image is fixed on the second size recording medium (e.g. a standard sized sheet called A4), a problem of causing a fixation irregularity and a wrinkle onto the second size recording medium occurs. In addition, there is another problem called as "hot offset" that the toner melts on a corresponding part to the first non-sheet passing region too much and adheres to the surface of the first rotating member, and consequently, dirties the surface of the following recording medium entering the fixing nip. Particularly, in a case of using the heat roller system, when the temperature of the first non-sheet passing region is heightened too much in comparison with the first sheet passing region, the first non-sheet passing region and first sheet passing region are different from each other in thermal expansion. Accordingly, a further problem is caused that the roller composing the first rotating member is distorted so that this roller deteriorates. Furthermore, when the ceramic heater is applied as the heat source, there is serious disadvantage of making the heater broken due to the non-uniformity of the temperature distribution.

Then, in order to prevent the non-uniformity of the temperature distribution, some fixing devices with IH system may apply a configuration for controlling magnetic flux distribution or properly using a plurality of different IH coils. However, when such a configuration is applied, it is feared that the controlling system for the fixing device is complicated to bring an increase in cost.

Thereupon, in order to prevent the non-uniformity of the temperature distribution without complicating the controlling system, the configurations of cooling the rotating member, such as the fixing roller, by an airflow blown from a fan are known as follows.

As an example, there is a configuration that a fan selectively blows an airflow toward a first rotating member of a first non-sheet passing region to prevent an increase in the temperature of the first non-sheet passing region. However, in this configuration, it is feared that a part of the airflow blown toward the first non-sheet passing region is fed to a first sheet passing region to decrease the temperature of the first sheet passing region.

As another example, there is another configuration that a plurality of airflow duct windows connected with a fan are provided in an axial direction of a first rotating member to adjust an opening angle of the airflow duct window by an airflow duct adjusting board. However, in this configuration, because the airflow duct adjusting board must be added, it is feared of complicating the structure of components and increasing cost. In addition, in a case of applying the so-called "external capsuled IH", in which an IH coil is placed outside the first rotating member, it is very difficult to secure a space for placing the airflow duct adjusting board around the first rotating member.

As a further example, there is a further configuration that a fan is inclined against a width direction of a first rotating member to minimize a cooling airflow going round to a first sheet passing region. However, in the further configuration, it is feared that the inclination of the fan causes no cooling airflow to a part of a first non-sheet passing region, and then, that reduction of cooling area causes reduction of cooling effect.

As a furthermore example, there is a furthermore configuration that a cooling airflow from a fan is blown toward a second rotating member to cool the second rotating member. However, when the cooling airflow is fed to the second rotating member and only heat transfer on the second rotating member cools a first rotating member, cooling efficiency of the first rotating member is lower than a case of cooling the first rotating member directly. Therefore, there is a problem that the fan must be enlarged in order to sufficiently cool the first rotating member.

SUMMARY

In accordance with an embodiment of the present disclosure, a fixing device includes a first rotating member, a second rotating member and a blowing unit. The first rotating member is heated by a heat source. The second rotating member is pressed against the first rotating member to form a fixing nip with the first rotating member and along a conveying path of a recording medium. The blowing unit blows a cooling airflow toward the first rotating member. An airflow route from the blowing unit to the first rotating member is arranged so as to cross the conveying path.

Furthermore, in accordance with an embodiment of the present disclosure, an image forming apparatus includes a fixing device. The fixing device includes a first rotating member, a second rotating member and a blowing unit. The first rotating member is heated by a heat source. The second rotating member is pressed against the first rotating member to form a fixing nip with the first rotating member along a conveying path of a recording medium. The blowing unit blows a cooling airflow toward the first rotating member. An airflow route from the blowing unit to the first rotating member is arranged so as to cross the conveying path.

The above and other objects, features, and advantages of the present disclosure will become more apparent from the following description when taken in conjunction with the accompanying drawings in which a preferred embodiment of the present invention is shown by way of illustrative example.

DETAILED DESCRIPTION

Figure 1:
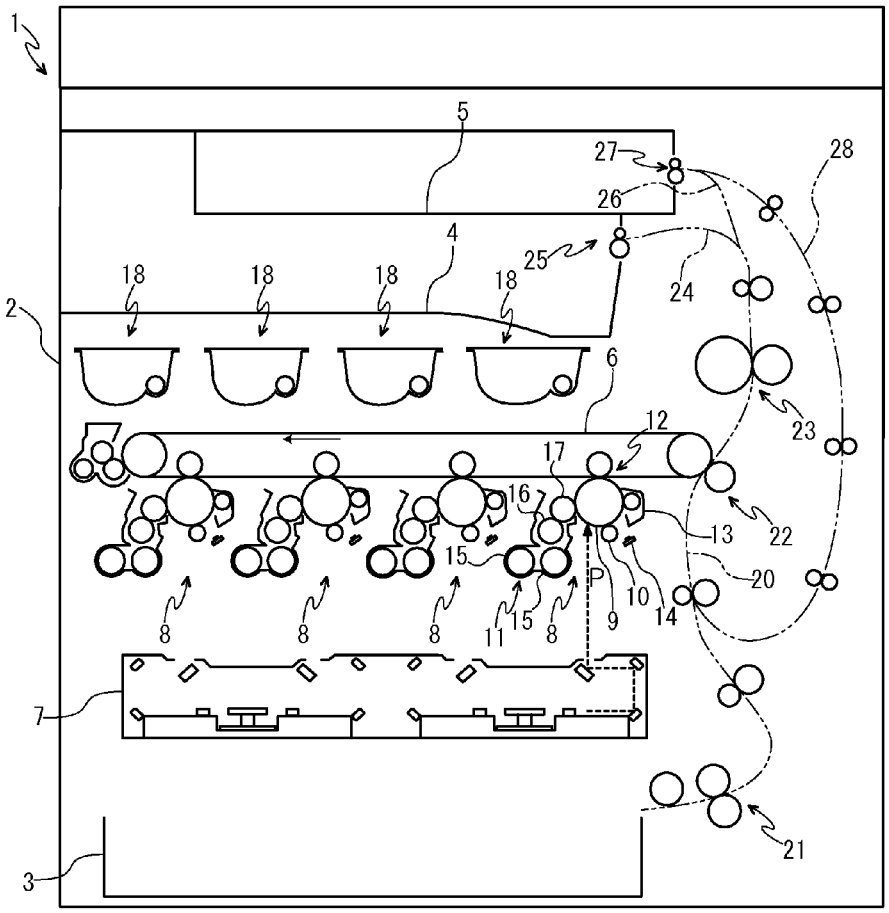
FIG. 1 is a schematic diagram schematically showing a printer according to an embodiment of the present disclosure.

With reference to FIG. 1, the entire structure of an electrographic printer 1 as an image forming apparatus will be described. FIG. 1 is a schematic diagram schematically showing the printer according to an embodiment of the present disclosure.

The printer 1 includes a box-formed printer main body 2. In a lower part of the printer main body 2, a sheet feeding cartridge 3 for storing sheets (not shown) as recording mediums is installed and, in a upper part of the printer main body 2, a first sheet ejecting tray 4 is mounted. Above the first sheet ejecting tray 4, a second sheet ejecting tray 5 is mounted.

Inside of the printer main body 2, an intermediate transferring belt 6 as an image carrier is bridged over a plurality of rollers and, below the intermediate transferring belt 6, an exposure device 7 is installed. The exposure device 7 consists of a laser scanning unit (LSU). Along a lower part of the intermediate transferring belt 6, four image forming units 8 are installed for respective colors of toners (developers).

One of the four image forming units 8 will be described. In the image forming unit 8, a photosensitive drum 9 is rotatably attached. Around the photosensitive drum 9, a charger 10, a development device 11, a first transferring unit 12, a cleaning device 13 and a static eliminator 14 are located in order of a first transferring process.

In a lower part of the development device 11, a pair of stirring rollers 15 are installed, diagonally above of the stirring rollers 15, a magnetic roller 16 is installed and, diagonally above of the magnetic roller 16, a developing roller 17 is installed. Above the development device 11, four toner containers 18 corresponding to the image forming units 8 are installed for different colors of toners, respectively.

At one side (the right-hand side of the figure) in the printer main body 2, a sheet conveying path 20 is arranged. At an upper stream end of the conveying path 20, a sheet feeder 21 is positioned. At an intermediate stream part of the conveying path 20, a second transferring unit 22 is positioned in contact with one end (a right end of the figure) of the intermediate transferring belt 6. At a lower stream part of the conveying path 20, a fixing device 23 is positioned.

The conveying path 20 branches off at its lower stream part than the fixing device 23 in upper and lower directions. At a lower stream end of the lower branched path 24, a first sheet ejecting unit 25 is positioned above one side (above right-hand side of the figure) of the first sheet ejecting tray 4. At a lower stream end of the upper branched path 26, a second sheet ejecting unit 27 is positioned above one side (above right side of the figure) of the second sheet ejecting tray 5. The second sheet ejecting unit 27 is connected with an upper stream part in the conveying path 20 than the second transferring unit 22 via an inversion path 28 for duplex printing arranged at one side (the right-hand side of the figure) of the conveying path 20.

Next, the operation of forming an image by the printer 1 having such a configuration will be described. When the power is supplied to the printer 1, various parameters are initialized and initial determination, such as temperature determination of the fixing device 23, is carried out. Subsequently, in the printer 1, when image data is inputted and a printing start is directed from a computer or the like connected with the printer 1, image forming operation is carried out as follows.

First, the surface of the photosensitive drum 9 is electrically charged by the charger 10. Then, exposure corresponding to the image data on the photosensitive drum 9 is carried out by a laser (refer to arrow P) from the exposure device 7, thereby forming an electrostatic latent image on the surface of the photosensitive drum 9. The electrostatic latent image is developed to a toner image having a correspondent color with a toner in the development device 11. The toner image is first-transferred onto the surface of the intermediate transferring belt 6 in the first transferring unit 12. The above-mentioned operation is repeated in order by the image forming units 8, thereby forming the toner image having full color onto the intermediate transferring belt 6. Toner and electric charge remained on the photosensitive drum 9 are eliminated by the cleaning device 13 and static eliminator 14.

On the other hand, a sheet fed from the sheet feeding cartridge 3 or a manual bypass tray (not shown) by the sheet feeder 21 is conveyed to the second transferring unit 22 in a suitable timing for the above-mentioned image forming operation. Then, in the second transferring unit 22, the toner image having full color on the intermediate transferring belt 6 is second-transferred onto the sheet. The sheet with the second-transferred toner image is conveyed to a lower stream on the conveying path 20 to enter the fixing device 23, and then, the toner image is fixed on the sheet in the fixing device 23. The sheet with the fixed toner image enters the lower branched path 24 or upper branched path 26. The sheet entering the lower branched path 24 is ejected from the first sheet ejecting unit 25 onto the first sheet ejecting tray 4. The sheet entering the upper branched path 26 is ejected from the second sheet ejecting unit 27 onto the second sheet ejecting tray 5 or conveyed to the inversion path 28 for duplex printing.

Figure 2:
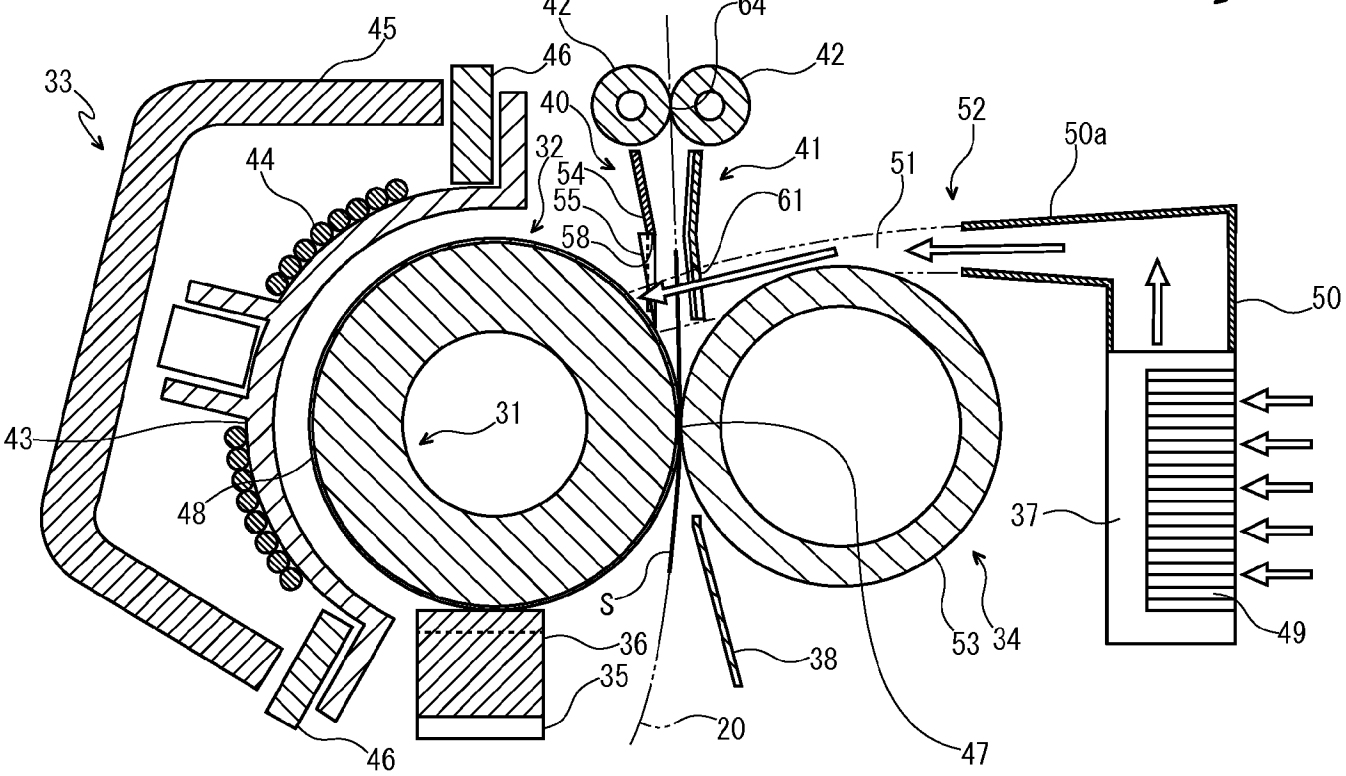
FIG. 2 is a sectional view showing a fixing device in the printer according to the embodiment of the present disclosure.
Figure 3:
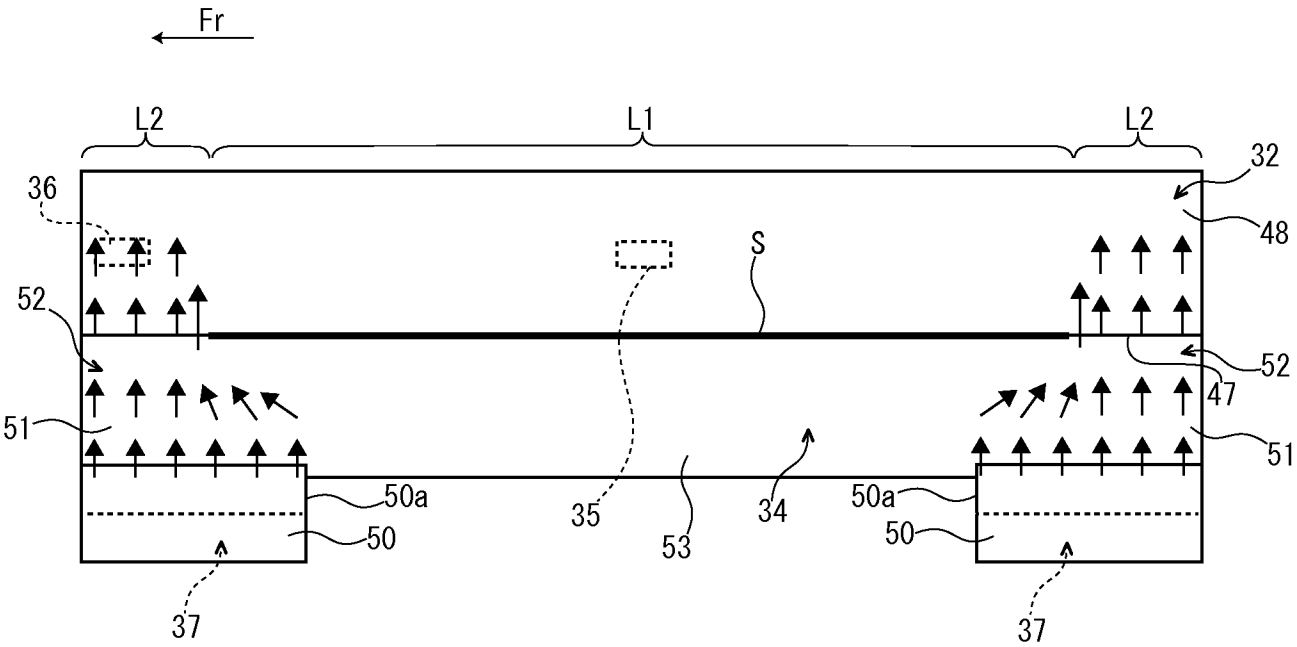
FIG. 3 is a plan view showing the fixing device in the printer according to the embodiment of the present disclosure.
Figure 4:
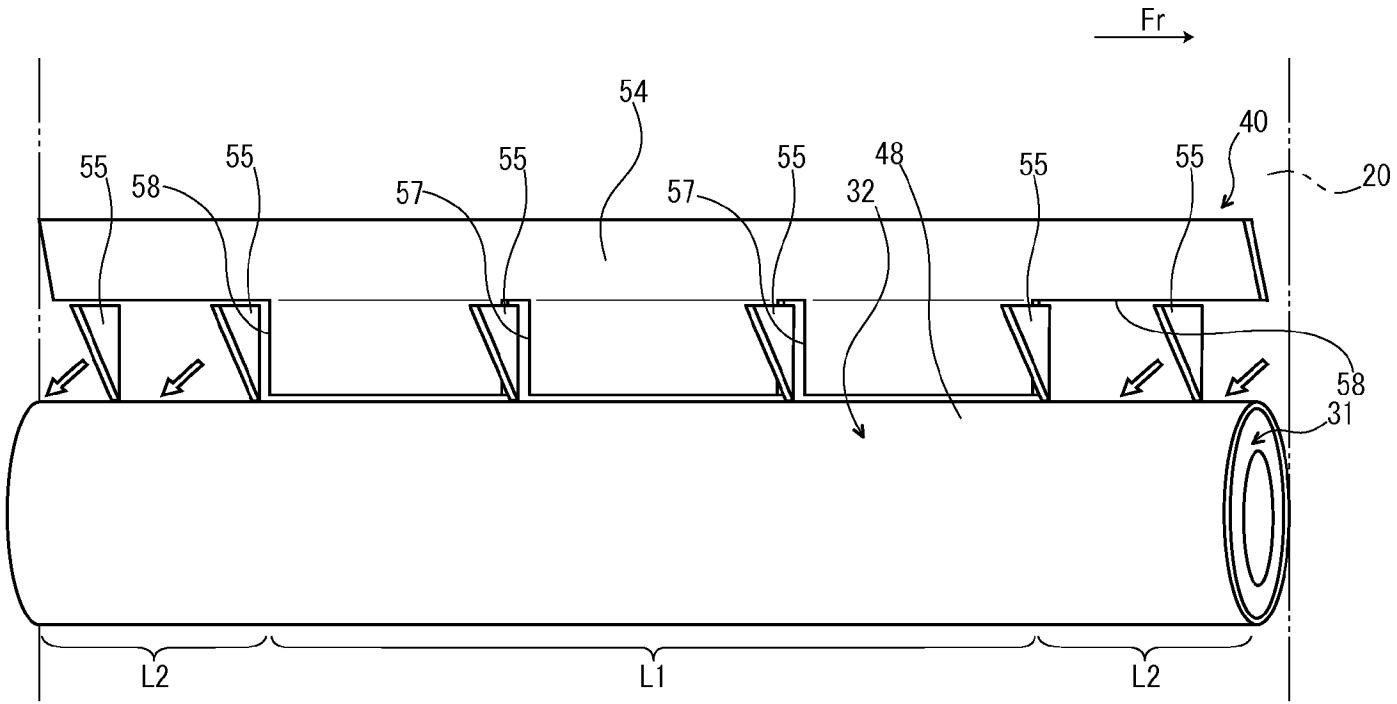
FIG. 4 is a perspective view showing a fixing roller, a fixing belt and a first conveyance guide in the printer according to the embodiment of the present disclosure.
Figure 5:
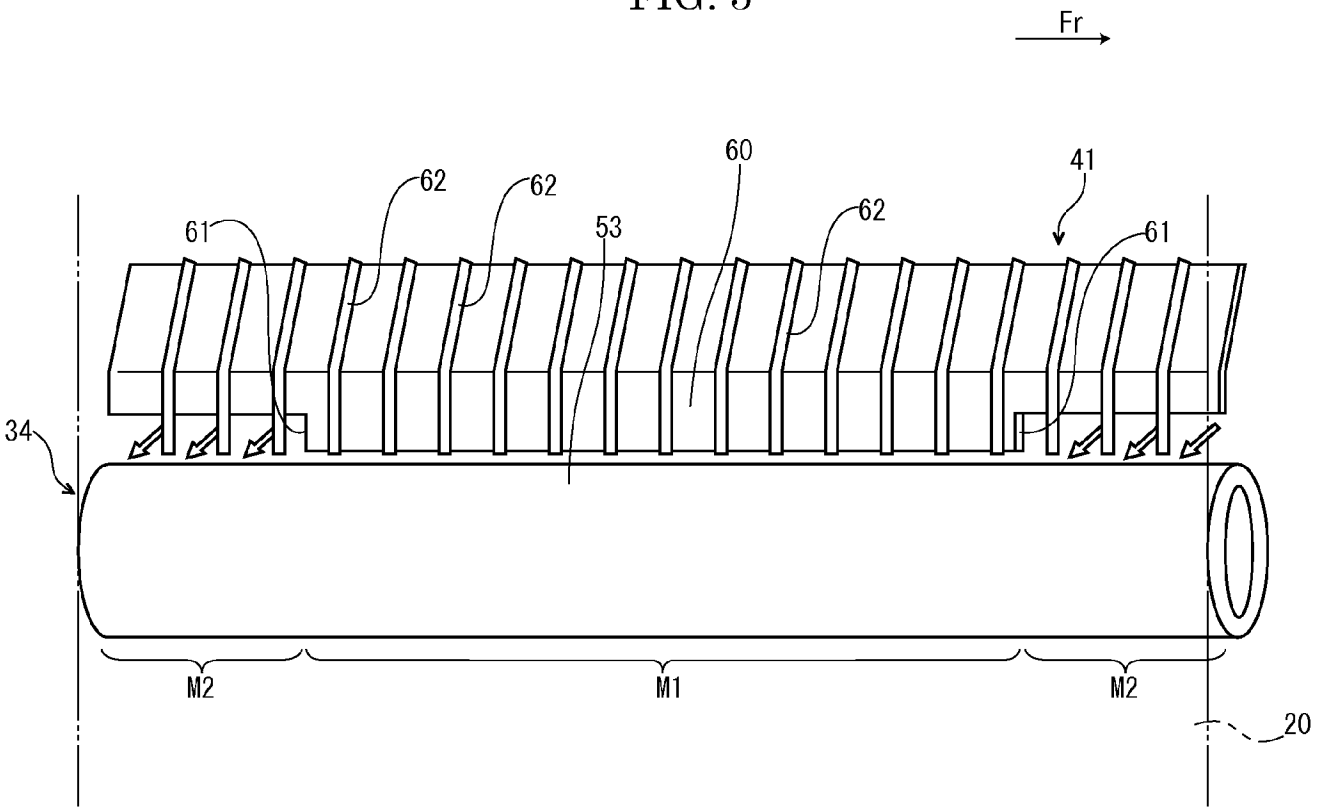
FIG. 5 is a perspective view showing a pressing roller and a second conveyance guide in the printer according to the embodiment of the present disclosure.

Next, with reference to FIGS. 2-5, the fixing device 23 will be described in detail. FIG. 2 is a sectional view showing the fixing device in the printer according to the embodiment of the present disclosure. FIG. 3 is a plan view showing the fixing device in the printer according to the embodiment of the present disclosure. FIG. 4 is a perspective view showing the fixing roller, fixing belt and first conveyance guide in the printer according to the embodiment of the present disclosure. FIG. 5 is a perspective view showing the pressing roller and second conveyance guide in the printer according to the embodiment of the present disclosure. Hereinafter, it will be described so that the front side of each component is positioned at the foreground side of FIG. 2. Arrows Fr suitably put on FIGS. 3-5 indicate the front side of each component.

As shown in FIG. 2, the fixing device 23 includes a fixing roller 31, a fixing belt 32, an IH fixing unit 33, a pressing roller 34, first and second thermistors 35 and 36, cooling fans 37, an entry guide 38, first and second conveyance guides 40 and 41, and a pair of conveying rollers 42. The fixing belt 32 is attached as a first rotating member around the fixing roller 31. The IH fixing unit 33 is installed at the left side of the fixing belt 32. The pressing roller 34 is installed as a second rotating member at the right side of the fixing belt 32. The first and second thermistors 35 and 36 are installed as first and second temperature detecting units below the fixing belt 32. The cooling fans 37 are installed as a blowing unit at the right side of the pressing roller 34. The entry guide 38 is installed below the left side of the pressing roller 34. The first conveyance guide 40 is installed above the right side of the fixing belt 32. The second conveyance guide 41 is installed above the left side of the pressing roller 34. The conveying rollers 42 are respectively installed further above the conveyance guides 40 and 41. The IH fixing unit 33, conveyance guides 40 and 41, and a pair of the conveying rollers 42 are omitted in FIG. 3.

The fixing roller 31 is formed in an extended-shape in forward and backward directions. For instance, the fixing roller 31 has an external diameter of 40 mm. The fixing roller 31 comprises a cylinder-formed core and an elastic layer arranged around the core. For instance, the core of the fixing roller 31 is made of metal, such as stainless steel or aluminum. For instance, the elastic layer of the fixing roller 31 is made of silicon sponge with a thickness of 10 mm.

The fixing belt 32 is formed in an extended-shape in the forward and backward directions. For instance, the fixing belt 32 comprises a base, an elastic layer arranged around the base and a release layer covering the elastic layer. For instance, the base of the fixing belt 32 is made of metal, such as nickel. For instance, the elastic layer of the fixing belt 32 is made of silicon rubber with a thickness of 0.2 mm. For instance, the release layer of the fixing belt 32 is made of PFA (tetrafluoroethylene perfluoroalkoxy vinyl ether copolymer) tube with a thickness of 0.03 mm.

As shown in FIGS. 3 and 4, on a part between the front and rear of the fixing belt 32, a first sheet passing region L1 is formed which a first size sheet (e.g. a standard sized sheet called B5) passes. In front and behind the first sheet passing region L1 (outside the first sheet passing region L1), first non-sheet passing regions L2 are formed, which a second size sheet (e.g. a standard sized sheet called A4) having a broader width in the forward and backward directions than the first size sheet passes.

As shown in FIG. 2, the IH fixing unit 33 includes an arc-formed bobbin 43, an IH coil 44, an arch core 45 and side cores 46. The bobbin 43 covers the left side of the fixing belt 32. The IH coil 44 is supported as a heat source on the bobbin 43 and attached on the outside of the fixing belt 32. That is, the IH fixing unit 33 in the embodiment may be a so-called "external capsuled IH". The arch core 45 covers the IH coil 44 and the side cores 46 are respectively installed at both sides of the arch core 45. For instance, the arch core 45 and side cores 46 are made of ferrite so as to form a magnetic route for making magnetic flux created by the IH coil 44 passed.

The pressing roller 34 is formed in an extended-shape in the forward and backward directions. For instance, the pressing roller 34 comprises a cylinder-formed core, an elastic layer mounted around the core and a release layer covering the elastic layer. For instance, the core of the pressing roller 34 is made of metal, such as stainless steel or aluminum. For instance, the elastic layer of the pressing roller 34 is made of silicon rubber with a thickness of 2.0 mm. For instance, the release layer of the pressing roller 34 is made of PFA tube with a thickness of 0.05 mm. The pressing roller 34 is pressed against the fixing belt 32 by biasing force of a biasing unit (not shown) and configured so as to rotate in the opposite direction to the fixing roller 31 and fixing belt 32 accompanying to the rotation of the fixing roller 31 and fixing belt 32.

Between the fixing belt 32 and pressing roller 34, a fixing nip 47 is formed along the conveying path 20 of the sheet. It is configured so that, when the sheet passes through the fixing nip 47, the toner image on the sheet is heated and pressed, and then, fixed on the sheet. In the embodiment, it is possible to fix the toner image onto the various sheets sized with different widths in the fixing nip 47.

As shown in FIG. 5, on a part between the front and rear of the pressing roller 34, a first sheet passing region M1 is formed which the first size sheet passes. In front and behind the first sheet passing region M1 (outside the first sheet passing region M1), first non-sheet passing regions M2 are formed, which the second size sheet having a broader width in the forward and backward directions than the first size sheet passes.

As shown in FIG. 3, the first thermistor 35 is located on the center in the forward and backward directions of the fixing belt 32 and provided on the first sheet passing region L1 of the fixing belt 32. The first thermistor 35 is a thermistor for controlling temperature and is a non-contact type temperature detecting unit located at predetermined intervals from the circumference face 48 of the fixing belt 32.

The second thermistors 36 are located on a front end of the fixing belt 32 and provided on the first non-sheet passing regions L2 of the fixing belt 32. The second thermistor 36 is a thermistor for detecting an increase in temperature and is a contact type temperature detecting unit in contact with the circumference face 48 of the fixing belt 32.

The cooling fan 37 is, for instance, a sirocco fan having a diameter of 50 mm. As shown in FIG. 2, the cooling fans 37 are located on the opposite side of the fixing roller 31 and fixing belt 32 across the conveying path 20 and pressing roller 34. As shown in FIG. 3, the cooling fans 37 are provided on both front and back ends of the pressing roller 34.

As shown in FIG. 2, the cooling fans 37 is provided with intake ports 49 so that a cooling airflow can be taken into the cooling fans 37 via the intake ports 49. With a top end of the cooling fans 37, a duct 50 is connected. One end 50*a* of the duct 50 is formed in a tapered-shape. On the extended line of the one end 50*a* of the duct 50, a communicating route 51 is made so that the communicating route 51 faces a top end of a circumference face 53 of the pressing roller 34. The communicating route 51 together with the duct 50 composes an airflow route 52 from the cooling fans 37 to the fixing belt 32. The airflow route 52 is arranged so as to cross the conveying path 20.

The entry guide 38 is located at the upper stream side from the fixing nip 47 and at the right side of the conveying path 20. The entry guide 38 extends in the upper direction slightly inclined to left. A top end of the entry guide 38 is provided adjacent to the circumference face 53 of the pressing roller 34.

The first conveyance guide 40 is located at the lower stream side from the fixing nip 47 and at the left side of the conveying path 20. As shown in FIG. 4 and other figure, the first conveyance guide 40 is formed in an extended-shape in the forward and backward directions. The first conveyance guide 40 comprises a guidance board 54 and a plurality of separation claws 55 supported on the guidance board 54.

A lower part of the guidance board 54 extends roughly in the upper and lower directions. An upper part of the guidance board 54 extends in the upper direction slightly inclined to left. The lower part of the guidance board 54 is provided with a plurality (two in the embodiment) of longitudinal insertion holes 57. The bottom end of the guidance board 54 faces the circumference face 48 of the fixing belt 32 at a slight interval. The interval is preferably 2 mm or less, or 1 mm in the embodiment. In the lower part of the guidance board 54, first openings 58 are formed at corresponding positions to the first non-sheet passing regions L2 of the fixing belt 32. In the embodiment, the first openings 58 are formed at front and back ends of the lower part of the guidance board 54.

An upper part of the separation claw 55 is supported on the guidance board 54 via a rotating shaft (not shown) so as to enable to rotate the separation claw 55 on the guidance board 54. The separation claw 55 is biased to the fixing belt 32 by a biasing member (not shown) and a bottom end of the separation claw 55 comes into contact with the circumference face 48 of the fixing belt 32. Accordingly, it is possible to separate the sheet from the fixing belt 32 by the separation claws 55. In the embodiment, six separation claws 55 are attached at intervals in the forward and backward directions. Two separation claws 55 located at the center in the forward and backward directions are inserted into the insertion holes 57 of the guidance board 54. Four separation claws 55 located at both sides in the forward and backward directions are inserted into the first openings 58.

As shown in FIG. 2, the second conveyance guide 41 is located at the lower stream side from the fixing nip 47 and at the right side of the conveying path 20 and faces the first conveyance guide 40 across the conveying path 20. As shown in FIG. 5 and other figure, the second conveyance guide 41 is formed in an extended-shape in the forward and backward directions. A lower part of the second conveyance guide 41 extends roughly in the upper and lower directions. An upper part of the second conveyance guide 41 extends in the upper direction slightly inclined to right.

In the lower part of the second conveyance guide 41, second openings 61 are formed at corresponding positions to the first non-sheet passing regions M2 of the pressing roller 34. In the embodiment, the second openings 61 are formed in front and back ends of the lower part of the second conveyance guide 41. On a conveying face (a left face in the embodiment) of the second conveyance guide 41, a plurality of guidance ribs 62 are formed at regular intervals in the forward and backward directions. A bottom end of the second conveyance guide 41 faces the circumference face 53 of the pressing roller 34 at a slight interval. The interval is preferably 2 mm or less, or 1 mm in the embodiment.

As shown in FIG. 2, the pair of the conveying rollers 42 are located at a lower stream side from the first and second conveyance guides 40 and 41. Between the pair of the conveying rollers 42, a conveying nip 64 is formed along the conveying path 20 of the sheet.

Figure 6:
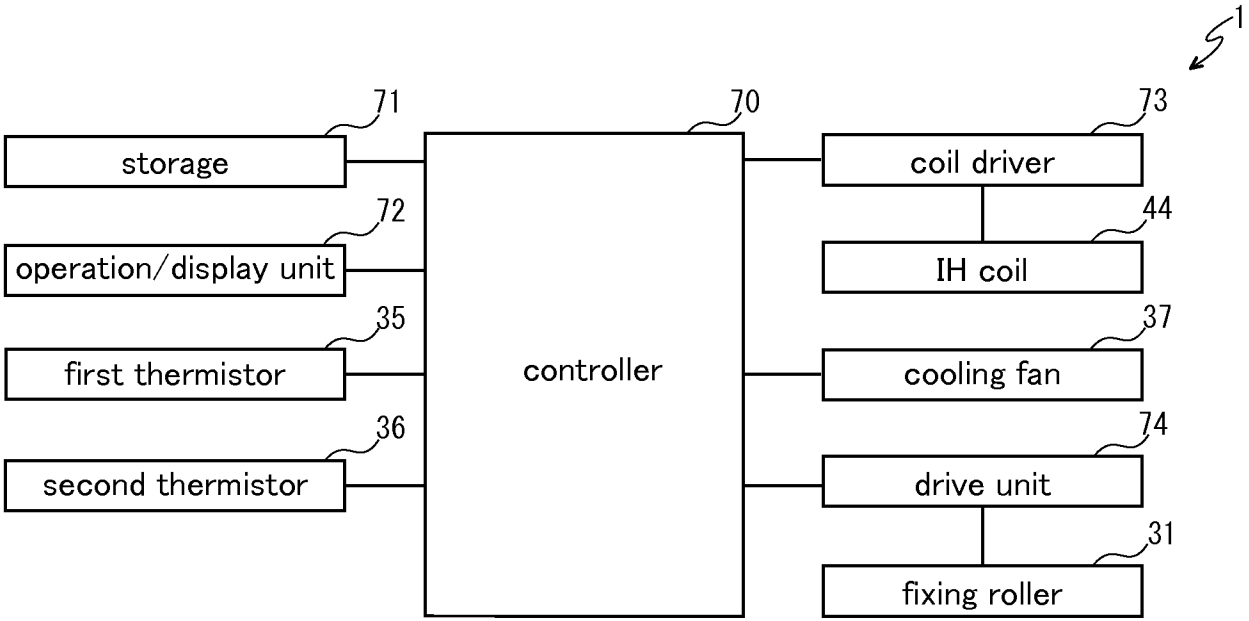
FIG. 6 is a schematic block diagram showing a configuration of the printer according to the embodiment of the present disclosure.

Next, mainly with reference to FIG. 6, a control system of the printer 1 will be described. FIG. 6 is a schematic block diagram showing the printer according to the embodiment of the present disclosure.

The printer 1 is provided with a controller (CPU: Central Processing Unit) 70. The controller 70 is connected with storage 71 comprising a storing device, such as a ROM (Read Only Memory) or a RAM (RandomAccess Memory). The control system is configured so that the controller 70 controls the components of the printer 1 on the basis of a control program or control data stored in the storage 71.

The controller 70 is connected with an operation/display unit 72 or a control panel attached on the printer main body 2. The operation/display unit 72 is provided with operation keys, such as a start key, a stop/clear key, a power key, numeric keys and a touch panel, and then, the control system is configured so that, when a user handles the operation keys, an indication according to the handling is outputted to the controller 70.

The controller 70 is connected with the first and second thermistors 35 and 36. The control system is configured so that, when the thermistor 35 or 36 detects the temperature of the fixing belt 32, a temperature detection signal from the thermistor 35 or 36 is outputted to the controller 70.

The controller 70 is connected with the IH coil 44 via a coil driver 73. On the basis of a drive command signal from the controller 70, the coil driver 73 sends a high frequency electric current to the IH coil 44 so that high frequency magnetic field is created in the IH coil 44. The control system is configured so that, by the high frequency magnetic field, the fixing belt 32 is heated.

The controller 70 is connected with the cooling fans 37. The control system is configured so that the cooling fans 37 are activated on the basis of activation command signal from the controller 70.

The controller 70 is connected with the fixing roller 31 via a drive unit 74 or a motor. The control system is configured so that the drive unit 74 makes the fixing roller 31 rotated on the basis of drive command signal from the controller 70.

In the fixing device 23 as mentioned above, an action of the cooling airflow when the toner image is fixed onto the first size sheet S (refer to FIGS. 2 and 3) will be described as follows.

When conveyance of the first size sheet S is begun from the upper stream side toward the fixing device 23, the cooling fans 37 are activated on the basis of activation command signal from the controller 70. Accordingly, as shown in FIG. 2, the cooling airflow is taken into the cooling fans 37 via the intake ports 49. The cooling airflow is blown from the cooling fans 37 toward the duct 50, and then, flows into the communicating route 51 from the one end 50*a* of the duct 50. The cooling airflow flowed into the communicating route 51 moves from the pressing roller 34 side (a right side in the embodiment) to the fixing belt 32 side (a left side in the embodiment) in the communicating route 51. Thereby, a top end of the pressing roller 34 is cooled.

The cooling airflow cooled the pressing roller 34 flows, as shown in FIG. 5, to the conveying path 20 side via the second openings 61 of the second conveyance guide 41. As shown in FIG. 3, one part of the cooling airflow, which goes toward the first sheet passing region L1 of the fixing belt 32, is cut off by the first size sheet S entered into the fixing nip 47. That is, the cooling airflow is hit against the first size sheet S to shift. By contrast, another part of the cooling airflow, which goes toward the first non-sheet passing region L2 of the fixing belt 32, goes straight without cutoff by the first size sheet S, and then, joins the one part of the cooling airflow hitting against the first size sheet S. Subsequently, as shown in FIG. 4, the cooling airflow is fed to the first non-sheet passing region L2 of the fixing belt 32 via the first openings 58 of the first conveyance guide 40. Thereby, the first non-sheet passing region L2 of the fixing belt 32 is cooled.

When the entire first size sheet S has passed through the fixing nip 47, on the basis of a signal from the controller 70, the cooling fan 37 is inactivated. When conveyance of the following first size sheet S is begun, the cooling fans 37 are reactivated on the basis of activation command signal from the controller 70.

In the embodiment, as mentioned above, because the cooling airflow can be fed to the first non-sheet passing region L2 of the fixing belt 32, it is possible to feed the cooling airflow from the cooling fan 37 to the first non-sheet passing region L2 of the fixing belt 32, thereby effectively cooling the first non-sheet passing region L2. It is therefore possible to even a temperature distribution of the fixing belt 32.

In addition, because the disclosure applies a configuration of preventing the cooling airflow from being fed to the first sheet passing region L1 of the fixing belt 32 by the first size sheet S, it is unnecessary to add new component and possible to simplify a configuration of the fixing device 23.

Further, by hitting the cooling airflow against the sheet after passing through the fixing nip 47, the sheet completed fixation can be cooled. It is therefore possible to prevent an increase in temperature of the conveyance guides 40 and 41 and adhesion of the sheets ejected onto the sheet ejecting tray 4 or 5 to each other.

Furthermore, in accordance with the dimension of the first size sheet S, the dimensions of the first sheet passing region L1 and first non-sheet pas sing region L2 are automatically adjusted. It is therefore possible, even if an uncertain sheet with a nonstandard width passes through the fixing nip 47, to effectively cool the first non-sheet passing region L2.

Moreover, because the top end of a circumference face 53 of the pressing roller 34 faces the communicating route 51 behaving as apart of the airflow route 52, apart of the airflow blown by the cooling fan 37 can be utilized for cooling the pressing roller 34. It is therefore possible to use both heat transfer on the pressing roller 34 and cooling airflow for cooling the pressing roller 34, thereby enhancing the cooling effect of the fixing belt 32.

For example, in case where the A4R-sized sheets are continuously fed about thirty minutes at a rate of fifty lots per minute until the saturated temperature is reached, when the cooling airflow is fed to only the pressing roller 34, the temperature of the first non-sheet passing region L2 of the fixing belt 32 reaches 245 degrees centigrade at most. By contrast, in the configuration of the embodiment, it is possible to restrain the temperature of the first non-sheet passing region L2 of the fixing belt 32 by 225 degrees centigrade or less.

In addition, by feeding the cooling airflow to the pressing roller 34, an increase in temperature of the pressing roller 34 can be restrained. It is therefore possible to prevent gloss variation in duplex printing of a coated paper and winding of a sheet around the pressing roller 34. Then, because the first non-sheet passing regions M2 of the pressing roller 34 also can be cooled, it is possible to even a temperature distribution of the pressing roller 34, too.

Further, because the first thermistor 35 is provided on the first sheet passing region L1 of the fixing belt 32, it is possible, when the first size sheet S passes through the fixing nip 47, to prevent the cooling airflow from feeding to first thermistor 35 by the sheet. Therefore, the first thermistor 35 can certainly detect the temperature of the first sheet passing region L1 of the fixing belt 32.

Furthermore, because the first thermistor 35 provided on the first sheet passing region L1 is a non-contact type, it is not feared that the first thermistor 35 slightly damages the release layer of the fixing belt 32. It is therefore possible to prevent a decrease in releasability from causing toner dirt. It is also possible to prevent disadvantage that a surface of a fixed image becomes uneven by the damage to cause gloss variation.

Still further, because the second thermistor 36 provided on the first non-sheet passing region L2 is a contact type, it is possible to certainly detect the temperature of the first non-sheet passing region L2 even if the cooling airflow is fed to the first non-sheet passing region L2.

In addition, at least while the sheet does not pass through the fixing nip 47 (e.g. before the elapse of determined time after a start of the image forming operation), the cooling fan 37 is inactivated. It is therefore possible, when the sheet does not pass through the fixing nip 47, to prevent the cooling airflow from being fed to the first thermistor 35. Therefore, the first thermistor 35 can more certainly detect the temperature of the first sheet passing region L1 of the fixing belt 32.

Further, the cooling fan 37 is located on front and back ends of the pressing roller 34 so as to feed the cooling airflow to the first non-sheet passing regions L2 of the fixing belt 32. It is therefore possible to further prevent the cooling airflow from being fed to the first sheet passing region L1 of the fixing belt 32 and to further enhance accuracy of temperature detection of the first thermistor 35.

Furthermore, the first conveyance guide 40 is provided with the first openings 58 at corresponding positions to the first non-sheet passing regions L2 of the fixing belt 32. The second conveyance guide 41 is provided with the second openings 61 at corresponding positions to the first non-sheet passing regions M2 of the pressing roller 34. By applying such a configuration, the conveyance guides 40 and 41 can prevent the cooling airflow from being fed to the first sheet passing region L1 of the fixingbelt 32, and simultaneously, the cooling airflow can certainly be fed to the first non-sheet passing regions L2 of the fixing belt 32 via the openings 58 and 61 formed in the conveyance guides 40 and 41. It is therefore possible to furthermore enhance accuracy of temperature detection of the first thermistor 35.

Particularly, in the embodiment, both intervals between the first conveyance guide 40 and fixing belt 32 and between the second conveyance guide 41 and pressing roller 34 are 1 mm, that is, the intervals are determined as small as possible. It is therefore possible to certainly prevent the cooling airflow from being fed to the first sheet passing region L1 of the fixing belt 32.

In addition, due to a configuration that the conveyance guides 40 and 41 of improving stability of sheet conveyance are utilized for guiding the cooling airflow to the first non-sheet passing regions L2 of the fixing belt 32, it is unnecessary to add new component and possible to simplify a configuration of the fixing device 23.

Further, by using the IH coil 44 as the heat source, in comparison with a case of using a halogen heater or the like as the heat source, it is possible to enhance heating rate and heating efficiency. Particularly, in the embodiment, the temperature distribution of the fixing belt 32 can be evened without adding new component, and therefore, it is not feared that added component interferes with the IH coil 44. Then, the so-called "external capsuled IH" placing the IH coil 44 outside the fixing belt 32 may be applied.

Figure 7:
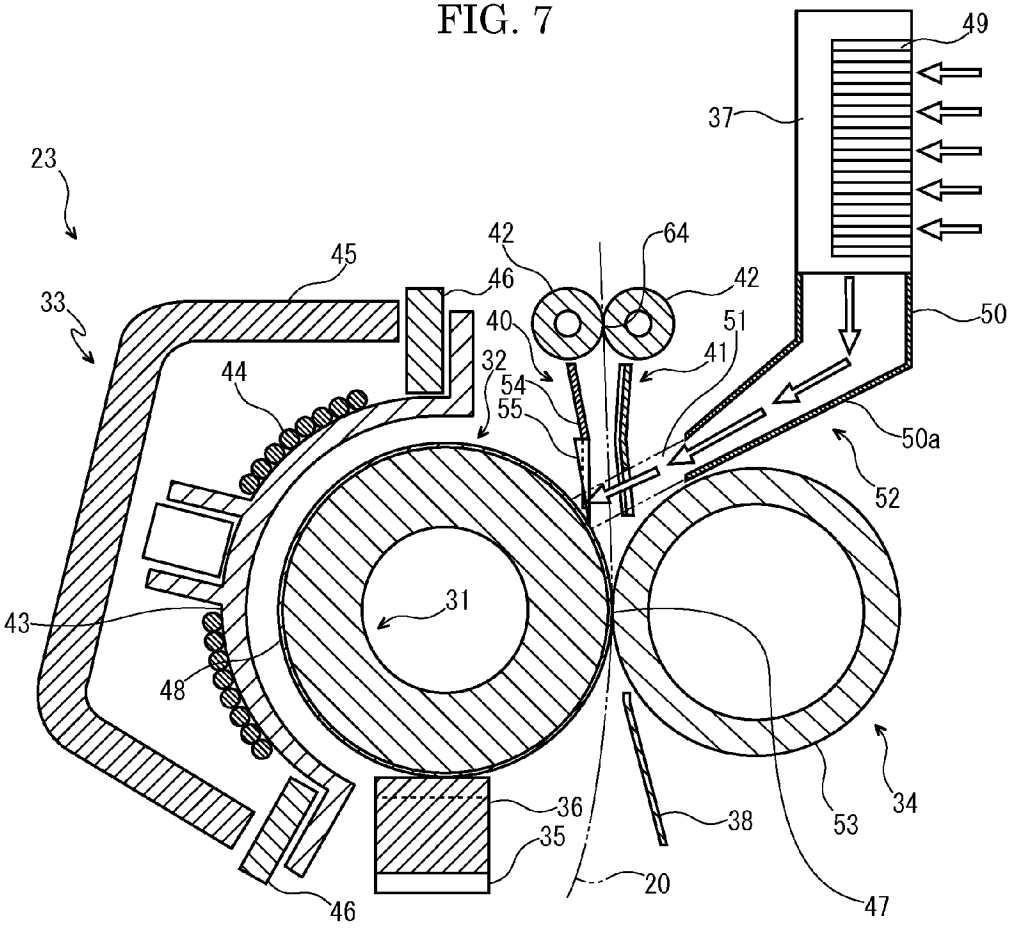
FIG. 7 is a sectional view showing a fixing device in a printer according to another embodiment of the present disclosure.

The embodiment was described in a case of cooling the fixing belt 32 by the cooling airflow for cooling the pressing roller 34. On the other hand, in another embodiment, as shown in FIG. 7, the airflow route 52 may be arranged at a distance from the pressing roller 34 so as to directly cool the fixing belt 32.

Although the embodiment was described in a case where the first rotating member is configured with the fixing belt 32, in a further embodiment, the first rotating member may be configured with the fixing roller 31 instead of the fixing belt 32.

Although the IH coil 44 is used as the heat source in the embodiment, in a furthermore embodiment, another heat source, such as a halogen heater or a ceramic heater, may be used.

Although the embodiment was described in a case of detecting the temperature of the fixing belt 32 as the first rotating member, still another embodiment may be configured so as to detect the temperature of the second rotating member (e.g. the pressing roller 34).

Although the embodiment was described in a case where the temperature detecting unit is configured with the thermistors 35 and 36, a still further embodiment may use another temperature detecting unit, such as an infrared sensor or the like.

Although the embodiment was described in a case where ideas of the disclosure are applied into the printer 1, as a furthermore embodiment, the ideas of the disclosure may be applied into another image forming apparatus except the printer 1, such as a copying machine, a facsimile or the like.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. A fixing device comprising:

a first rotating member heated by a heat source;

a second rotating member pressed against the first rotating member to form a fixing nip with the first rotating member along a conveying path of a recording medium; and a blowing unit configured to blow a cooling airflow toward the first rotating member, wherein an airflow route from the blowing unit to the first rotating member is arranged so as to cross the conveying path, and the airflow route includes:

a duct connected with the blowing unit; and a communicating route arranged on an extended line of one end of the duct, and a part of the second rotating member is located in the communicating route, wherein the fixing nip is formed so that different sized recording mediums can pass therethrough, on a circumference face of the second rotating member, a first sheet passing region which a first size sheet passes and a first non-sheet passing region arranged outside the first sheet passing region which a second size sheet having a broader width than the first size sheet passes are formed, wherein at one side of the conveying path, a conveyance guide is provided so as to cross the airflow route, wherein the conveyance guide comprises an opening at a corresponding position to the first non-sheet passing region, and wherein the conveyance guide comprises a protrusion extending into the opening.

2. The fixing device according to claim 1, wherein the blowing unit is located on an opposite side of the second rotating member from the first rotating member, and at least a part of a circumference face of the second rotating member faces the airflow route.

3. The fixing device according to claim 1, wherein on a circumference face of the first rotating member, a first sheet passing region which a first size sheet passes and a first non-sheet passing region arranged outside the first sheet passing region which a second size sheet having a broader width than the first size sheet passes are formed, and on the first sheet passing region of the first rotating member, a first temperature detecting unit is installed.

4. The fixing device according to claim 3, wherein the first temperature detecting unit is a non-contact type, and on the first non-sheet passing region of the first rotating member, a second temperature detecting unit of a contact type is installed.

5. The fixing device according to claim 3, wherein the blowing unit is configured to be inactivated at least while the recording medium does not pass through the fixing nip.

6. The fixing device according to claim 3, wherein the blowing unit is provided so as to feed the cooling airflow to the first non-sheet passing region of the first rotating member.

7. The fixing device according to claim 1, wherein the heat source has an IH coil.

8. The fixing device according to claim 7, wherein the IH coil is located outside the first rotating member.

9. The fixing device according to claim 1, wherein the one end of the duct is formed in a tapered-shape.

10. The fixing device according to claim 1, wherein the first rotating member has a fixing belt, and the second rotating member has a pressing roller.

11. An image forming apparatus comprising:

a fixing device which includes a first rotating member heated by a heat source, a second rotating member pressed against the first rotating member to form a fixing nip with the first rotating member along a conveying path of a recording medium and a blowing unit configured to blow a cooling airflow toward the first rotating member, wherein an airflow route from the blowing unit to the first rotating member is arranged so as to cross the conveying path, and the airflow route includes:

a duct connected with the blowing unit; and a communicating route arranged on an extended line of one end of the duct, and a part of the second rotating member is located in the communicating route, wherein the fixing nip is formed so that different sized recording mediums can pass therethrough, on a circumference face of the second rotating member, a first sheet passing region which a first size sheet passes and a first non-sheet passing region arranged outside the first sheet passing region which a second size sheet having a broader width than the first size sheet passes are formed, wherein at one side of the conveying path, a conveyance guide is provided so as to cross the airflow route, wherein the conveyance guide comprises an opening at a corresponding position to the first non-sheet passing region, and wherein the conveyance guide comprises a protrusion extending into the opening.

12. The image forming apparatus according to claim 11, wherein the blowing unit is located on an opposite side of the second rotating member from the first rotating member, and at least a part of a circumference face of the second rotating member faces the airflow route.

13. The image forming apparatus according to claim 11, wherein on a circumference face of the first rotating member, a first sheet passing region which a first size sheet passes and a first non-sheet passing region arranged outside the first sheet passing region which a second size sheet having a broader width than the first size sheet passes are formed, and on the first sheet passing region of the first rotating member, a first temperature detecting unit is installed.

14. The image forming apparatus according to claim 13, wherein the first temperature detecting unit is a non-contact type, and on the first non-sheet passing region of the first rotating member, a second temperature detecting unit of a contact type is installed.

15. The image forming apparatus according to claim 13, wherein the blowing unit is configured to be inactivated at least while the recording medium does not pass through the fixing nip.

16. The image forming apparatus according to claim 13, wherein the blowing unit is provided so as to feed the cooling airflow to the first non-sheet passing region of the first rotating member.

17. The image forming apparatus according to claim 11, wherein the heat source has an IH coil.

* * * * *